US009272184B1

(12) United States Patent
James et al.

(10) Patent No.: US 9,272,184 B1
(45) Date of Patent: Mar. 1, 2016

(54) EXERCISE CONTACT COUNTER DISPLAY TRACKING REPETITIVE HITS

(71) Applicants: Eliza James, Salt Lake City, UT (US); Lori A. Leighton, Salt Lake City, UT (US)

(72) Inventors: Eliza James, Salt Lake City, UT (US); Lori A. Leighton, Salt Lake City, UT (US)

(73) Assignee: Boxing Is For Girls, LLC, Salt Lake City, UT (US)

( * ) Notice: Subject to any disclaimer, the term of this patent is extended or adjusted under 35 U.S.C. 154(b) by 0 days.

(21) Appl. No.: 14/461,943

(22) Filed: Aug. 18, 2014

(51) Int. Cl.
*A63B 71/00* (2006.01)
*A63B 24/00* (2006.01)

(52) U.S. Cl.
CPC ..... *A63B 24/0062* (2013.01); *A63B 2024/0065* (2013.01)

(58) Field of Classification Search
None
See application file for complete search history.

(56) References Cited

U.S. PATENT DOCUMENTS

| | | | | |
|---|---|---|---|---|
| 4,534,557 | A * | 8/1985 | Bigelow | A63B 43/00 273/446 |
| 5,164,967 | A | 11/1992 | Endo et al. | |
| 5,469,740 | A * | 11/1995 | French | A61B 5/1036 273/445 |
| 5,857,939 | A | 1/1999 | Kaufman | |
| 6,464,622 | B1 * | 10/2002 | Clark | A63B 24/0021 482/1 |
| 6,796,925 | B2 | 9/2004 | Martinez et al. | |
| 7,060,000 | B2 * | 6/2006 | Carlson | A63B 69/0053 434/250 |
| 8,079,938 | B2 * | 12/2011 | Jones | A63B 69/32 482/8 |
| 8,998,783 | B2 * | 4/2015 | Orenstein | A63B 21/1473 482/141 |

* cited by examiner

*Primary Examiner* — Glenn Richman
(74) *Attorney, Agent, or Firm* — Marcus G. Theodore

(57) ABSTRACT

A layered exercise contact counter display tracking and showing repetitive contacts with the lens contact surface of a housing covering a sensor pad, which responds to contacts sending a signal to a powered circuit board to record and display the number of repetitive hits adapted for mounting on an exercise device or a support surface to encourage an exerciser to complete and exercise or contact event.

16 Claims, 4 Drawing Sheets

EXERCISE CONTACT COUNTER DISPLAY TRACKING REPETITIVE HITS

RELATED APPLICATIONS

This patent application claims the benefit of the provisional patent application, entitled "Exercise Contact Counter Display Tracking Repetitive Hits" filed Aug. 25, 2013, Ser. No. 61/869,719.

BACKGROUND OF THE INVENTION

1. Field

This invention pertains to exercise devices. More particularly, it pertains to a contact counter display tracking and showing repetitive contacts by an exerciser or an exercise ball or device.

2. State of the Art

Various exercise repetitious motion counters are known. Martinez et al., U.S. Pat. No. 6,796,925 issued Sep. 28, 2004 discloses a repetition counter display operably associated with a proximity sensor activated when brought into non-contact proximity to the proximity sensor by an exerciser. This device counts repetitions, but does not encourage a user to complete the exercise. Endo et al., U.S. Pat. No. 5,164,967 issued Nov. 17, 1992 discloses a Pedometer for walking, jogging, etc. responsive to the number of steps of the exercise, the period of time thereof, and the continuation period of time using audible sound cues produced in an earphone making the user conscious of the exercise at the appropriate intensity.

Kaufman, U.S. Pat. No. 5,857,939 issued Jan. 12, 1999 discloses a device for monitoring the progress and performance of an exercise routine and for insuring that the exercise routine is correctly performed. It incorporates an exercise monitor utilizing an exercise motion detector, such as an accelerometer, for detecting the repetitive motion associated with the performance of successive exercise repetitions and for outputting a corresponding repetition signal. The exercise monitor is preferably encased or packaged to may work on the user's wrist, ankle, waist, glove, neck, hat, and the like. Alternatively the exercise monitor may be encased in a piece of exercise equipment or an exercise mat, in which case the motion detector comprises a switch capable of detecting successive repetitions, such as presses, extensions, pushups, or sit-ups. The monitor then produces a voice count for each repetition, and may include motivation speech generated to encourage correct and continued performance of the exercise. Kaufman's motion detector often misreads an exerciser's performance of an exercise, and fails to provide visual signals of the number repetitions.

There remains a need for an exercise tracking device responsive to repetitive hits insuring that an exerciser fully completes the exercise, while providing audio and visual signals to encourage the performance of the exercises. It may also be programmed to input a user's performance history into a computer to provide tracking progress. The device described below provides such a device.

SUMMARY OF THE INVENTION

The present invention comprises a contact counter with a lighted display made of a contact resistant material, such as Plexiglas. The lighted display includes a light circuit, which lights up to display sequential numbers in response to the number of contacts made with the display. The lighted display is powered by a power source and activated by a pressure contact power switch to sequentially light up the display showing the number of hits when a user or his/her exercise aids, balls, or devices contact the contact counter lighted display's pressure contact power switch.

In addition to the visual display, a sound circuit may be included, which activates a voice synthesizer to verbally speak the number count corresponding to the numerical display. This sound circuit may also include verbal encouragement messages to the exerciser to complete the exercise repetitions, or extend their performance.

In one embodiment, a clock is also included to time the completion of the exercises. This embodiment may also store the exercise times and the number of hits generated representing each exercise repetition completed. The stored exercise times and exercise repetitions completed may then be downloaded into a computer exercise program allowing each exerciser to track their performance.

These distinctive large lighted displays are particularly well suited to track exercise competitions where the audience can easily follow each competitor's progress.

The present invention contemplates several different versions:

Box Jump

The box jump is a stepping platform where an exerciser jumps and squats onto the box. It is made in various heights supporting the contact counter with a lighted display. As an exerciser contacts the lighted display on top of the box jump, a number is displayed of the number of contacts made with the counter and the sound circuit speaks the count.

Wall Ball Mount

The Wall Ball Mount is a wall mounted contact counter with a lighted display, which lights up with the count of the number of times it is contacted when hit by a user, a ball, etc. It also verbally speaks the count.

Floor Mounted Push Up/Burpee/AB Mount

The floor mounted Push Up/Burpee/AB Mount has a floor mounted contact counter with lighted display structured to be contacted by an exerciser completing an exercise by contacting the counter to light up the display with the number of times it is contacted. This insures that the user fully completes the exercise by actually contacting the ground. It also verbally speaks the count and may include verbal phrases or words of encouragement.

Punching Bag Mount

The contact counter with lighted display may also be mounted on a punching bag to record the number of punches delivered during an exercise routine.

All of the above exercise apparatuses include a contact counter with lighted display with different programming capabilities. Programming components, such as a signal processor, and accelerometer are associated with a control panel, which allow the same contact counter with lighted displays to be adjusted for use with different workouts.

SUMMARY

In summary, the contact counter with lighted display is adapted to be associated with a variety of exercise equipment in a manner to insure that a user accurately completes and exercise, by providing audio and visual tracking of repetition contacts and hits. It also provides verbal incentives and encouragement to an exerciser. Individual results may also be stored in an electrical circuit and downloaded into a computer.

DESCRIPTION OF THE ILLUSTRATED EMBODIMENTS

Figure 1:
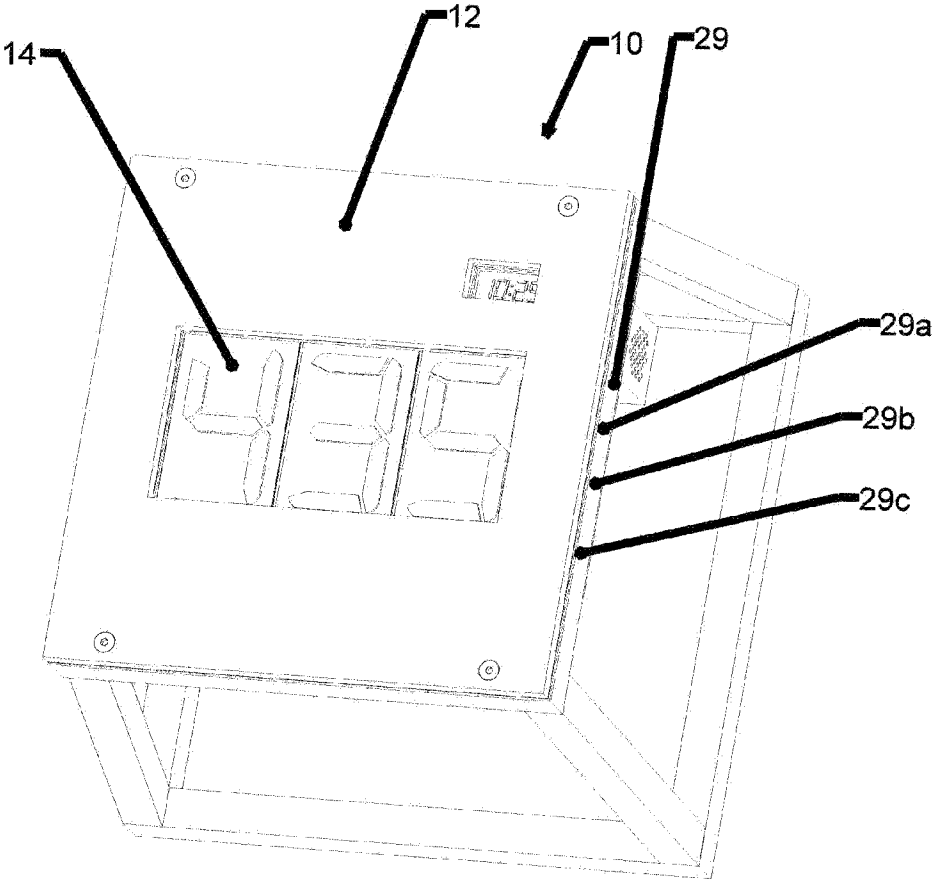
FIG. 1 illustrates a perspective view of one embodiment of the invention.

FIG. 1 illustrates a perspective view of one embodiment of the invention 10 adapted as a box jump. The lighted contact display 12 is affixed to the top of the box jump 10, which displays a numeral 14 corresponding to the number of contacts made by a user with the surface of the lighted contact display 12.

Figure 2:
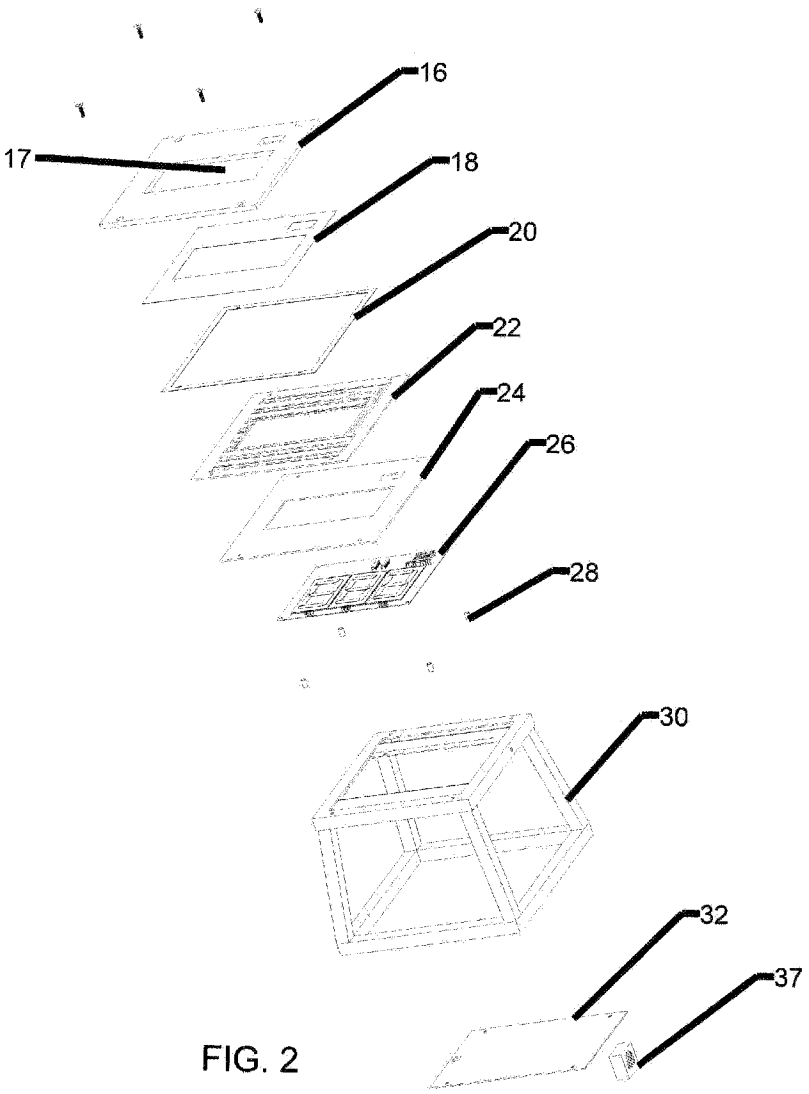
FIG. 2 illustrates an exploded view of the components of FIG. 1.

FIG. 2 illustrates an exploded view of the components of FIG. 1. The lighted contact display 12 comprises a layered display lens/top face 16 with display cutouts 17 covering a contact foil 18 placed on top of a perimeter foam off-set pad 20, which separates the sensor pad 22. These are supported by a steel plate 24 resistant to repetitive exercise contacts providing rigidity to the lighted contact display 12 covering and protecting the main board 26 with aligned cut-outs 17 to allow the numerals 14 of the main board 26 to be visible. These layered components of the lighted contact display 12 are secured together with fasteners 28.

The foam off-set pad 20 is constructed of a thickness and rigidity to require a pre-determined contact force be applied to the lighted contact display 12 to register a hit. This pre-set contact force insures that minimal accidental contacts are not recorded. In some embodiments, an accelerometer 42 may be included to selectively adjust the contact force required to register a hit.

A side control panel 29 is operably associated with a signal processor 36 and battery connector 44 power source includes an on-off re-set button switch 29 shown in FIG. 1 to re-set the circuit to record repetition contacts for each exercise. A number of contact button 29*a* is included for an exerciser to set the number of contacts per repetition. A number of repetitions button 29*b* is included for an exerciser to track the number of repetitions completed per exercise. An optional force selection button 29*c* is also included where an exerciser selects the hitting force required to establish a hit.

The lighted contact display 12 is then affixed to the main frame 30 of the box jump with a rear plate 32, which secures the lighted contact display 12 to the main frame 30.

Figure 3:
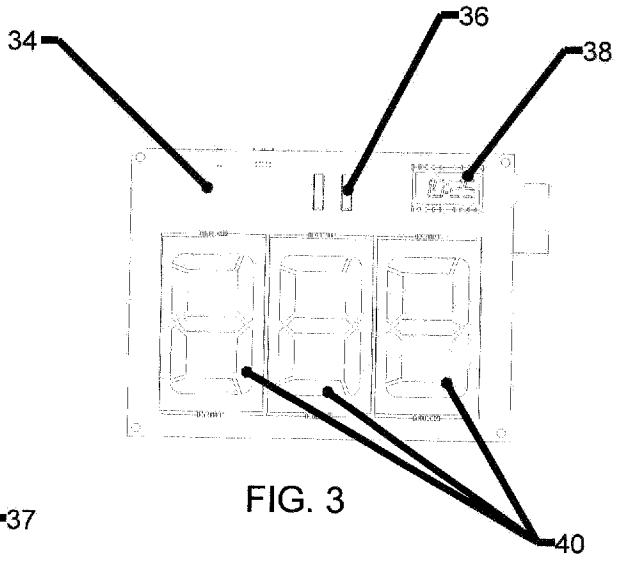
FIG. 3 illustrates the printed circuit board of the lighted contact board of FIG. 1.

FIG. 3 illustrates the printed circuit board 34 of the lighted contact display 12, which includes interconnected processors 36 to drive displays and register hits, timer liquid crystal displays 38, and large number liquid display units 40.

Figure 4:
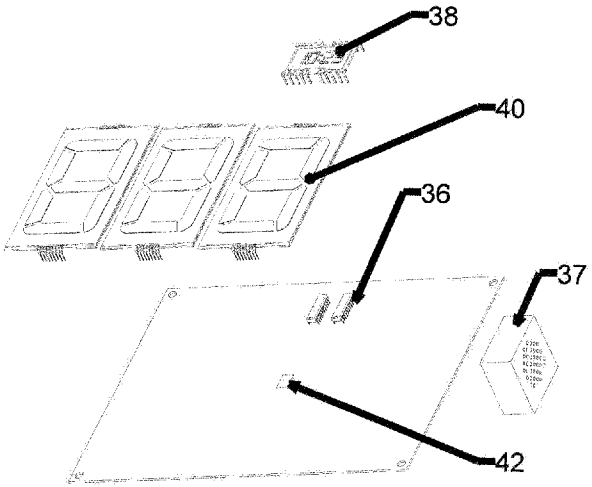
FIG. 4 illustrates an exploded view of the components of FIG. 3.

FIG. 4 illustrates an exploded view of the components of FIG. 3 revealing the accelerometer 42 located beneath one of the liquid crystal display units 40, which detects contact force. It also shows a sound speaker with voice synthesizer 37 activated by the interconnected processor 36.

Figure 5:
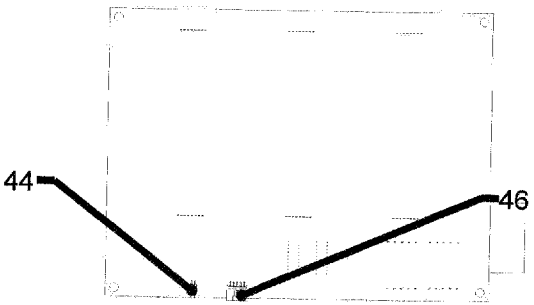
FIG. 5 illustrates the underside of the lighted display of the embodiment shown in FIG. 3.

FIG. 5 illustrates the underside of the lighted contact display 12 of the embodiment shown in FIG. 3 showing the battery connector 44 and force sensor connector 46 powering and driving the major components of the lighted contact display 12.

Figure 7:
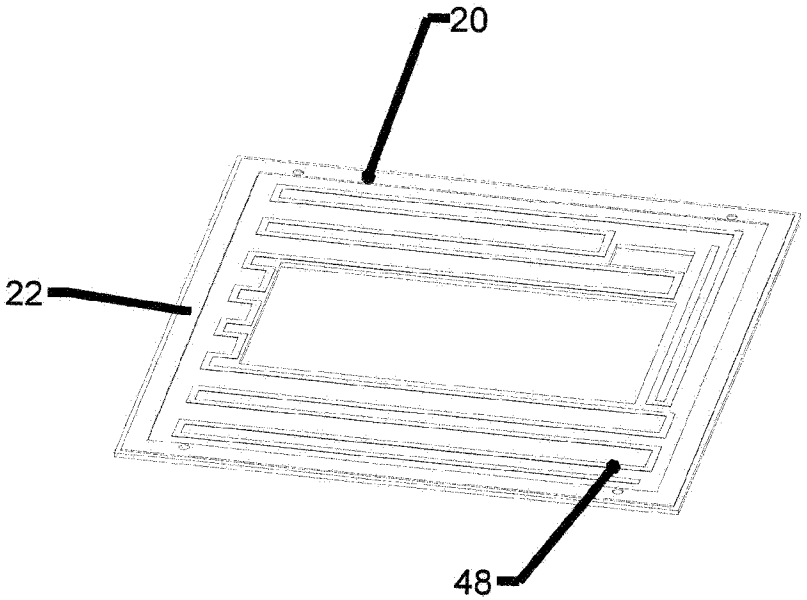
FIGS. 6 and 7 illustrate the lighted display contacts of the invention.
Figure 6:
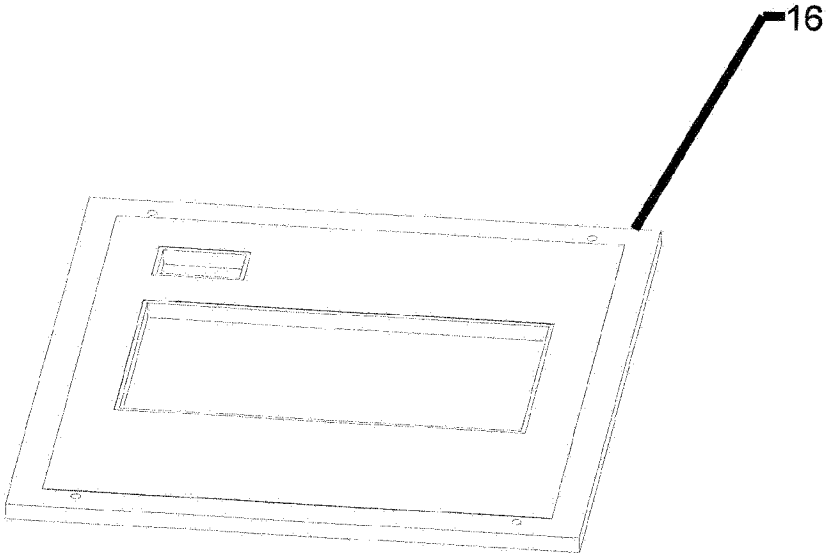

The battery connector 44 power source energizes a closed circuit when the contact foil 18 of FIG. 6 contacts the foam separated contact traces 48 of the sensor pad 22 shown in FIG. 7. This sends a signal, which activates the lighted contact display 12 and the processors 36 to drive displays and register hits, which not only lights the display, but records the number of contacts made per exercise session.

The information stored by the processors 36 may be downloaded into a computer via wires or wireless connections (not shown). An optional speaker (not shown) may be operably associated with the lighted contact display 12 to speak the number of contacts displayed via a synthesized voice circuit. In addition, the timer liquid crystal display 38 is wired to the battery connector 44 power source to display the elapsed time of the exercise The color of the liquid crystal display units 40 and timer liquid crystal display 38 are selected to display the repetitions in bold powerful colors, such as red as incentives to the exerciser. The optional speaker may also be programmed with verbal incentives and encouragement to the exerciser.

The lighted contact display 12 may be adapted as a floor or wall mounted embodiment of the invention 10. These variations may be mounted on a wall as a Wall Ball Mount displaying the number of hits made by an exerciser throwing a ball at it, or as a floor mounted Push up/Burpee/AB Mount displaying the number of times the lighted contact display 12 is contacted by the exerciser. The wall mounts of the lighted contact display may be of any configuration to secure the invention 10 to the wall when repeatedly struck.

The present invention may be embodied in other specific forms without departing from its structures, methods, or other essential characteristics as broadly described herein and claimed hereinafter. The described embodiments are to be considered in all respects only as illustrative, and not restrictive. The scope of the invention is, therefore, indicated by the appended claims, rather than by the foregoing description. All changes that come within the meaning and range of equivalency of the claims are to be embraced within their scope.

We claim:

1. An exercise contact counter display tracking repetitive contacts comprising:

a. a housing made of a contact resistant material with structure adapted to mount onto a frame of an exercise device or to a support surface, b. a contact counter switch activated when a pre-set contact force is encountered affixed to the housing in a position to record repetitive pressure contacts, c. a numerical display associated with the contact counter switch adapted to display the number of contacts, d. a processor associated with the contact counter to record and store exercise times and number of contacts for each exercise program, e. a power source associated with the contact counter switch and numerical display and processor to sequentially activate the contact counter switch and numerical display to show the number of contacts when a user or his/her exercise aids, balls, and devices contact the pressure contact power switch, and f. a control panel associated with the power source, contact counter switch, and numerical display to adjust the number of contacts per exercise repetition, the number of repetitions, time completion, and force required to register a hit for each exercise.

2. An exercise contact counter display according to claim 1, including a clock associated with the control panel to time completion of exercises.

3. An exercise contact counter display according to claim 1, including a sound circuit operably associated with the numerical display, which activates a voice synthesizer to verbally speak the number of contacts shown on the numerical display.

4. An exercise contact counter display according to claim 3, wherein the sound circuit also includes verbal encouragement messages for the exerciser to complete exercise repetitions, or extend their performance.

5. An exercise contact counter display according to claim 1, wherein the numerical display is a lighted display.

6. An exercise contact counter display according to claim 5, wherein the lighted display is structured to be visible to an audience enabling them to follow each exerciser's progress during competitions.

7. An exercise contact counter display according to claim 6, wherein the stored exercise times and number of contacts generated for each exercise repetition completed is downloadable from the processor into an exerciser's computer exercise program allowing the exerciser to track their performance.

8. An exercise contact counter display according to claim 1, including an accelerometer located beneath the numerical display and associated with the contact counter and processor to detect contact force for display by the numerals of the numerical display.

9. An exercise contact counter display tracking repetitive contacts, comprising:

a. a display lens/top face with display cutouts, b. a contact foil with corresponding display cutouts, c. a foam off-set pad placed around a perimeter of the contact foil, d. a sensor pad with corresponding display cutouts separated from the contact foil by the foam off-set pad; said foam off-offset pad of a thickness and rigidity to require a pre-set contact force to be applied to the display lens/top to before the contact foil contacts the sensor pad, e. a reinforcing plate structured to withstand repetitive contacts with corresponding cutouts, f. a circuit board with display numerals sized to fit within the cutouts, when aligned, to activate the display numerals of the circuit board to display the number of contacts through the cutouts; the layered display lens/top face, contact foil, foam off-set pad, sensor pad, steel reinforcing place and main circuit board components are secured together with fasteners, g. a processor associated with the circuit board to record and store exercise times and number of contacts required for each exercise program, h. a power source operably associated with the circuit board, processor, sensor pad, and display numerals to activate them to record and display repetitive contacts, i. a control panel associated with the power source, processor, and circuit board for an exerciser to adjust the number of contacts per exercise repetition, the number of repetitions, completion times, and force required to register a hit, and j. a backing plate securing the display lens/top face, contact foil, foam off-set pad, steel reinforcing plate, circuit board, and power source together, including mounting structure to affix the contact counter display to a frame of an exercise device or to a support surface.

10. An exercise contact counter display according to claim 9, including a clock associated with the circuit board to time completion of exercises.

11. An exercise contact counter display according to claim 9, including an on-off re-set switch associated with the control panel to re-set the circuit board and processor to record repetitive contacts for each exercise.

12. An exercise contact counter display according to claim 9, including an accelerometer located beneath the display lens/top face and associated with the sensor pad and circuit board to detect contact force for display by the numerals of the circuit board.

13. An exercise contact counter display according to claim 9, including a synthesized voice sound circuit and speakers associated with the circuit board to speak the number of contacts displayed.

14. An exercise contact counter display according to claim 13, wherein the synthesized voice sound circuit and speakers are programmed to provide verbal incentives and encouragement to an exerciser.

15. An exercise contact counter display according to claim 9, wherein the display unit colors and size show the number of repetitive contacts in bold powerful colors as incentives to the exerciser.

16. An exercise counter display according to claim 9, wherein the lighted display is structured to be visible to an audience enabling them to follow each exerciser's progress during competitions.

* * * * *